United States Patent [19]

Deaton

[11] Patent Number: 4,632,187

[45] Date of Patent: Dec. 30, 1986

[54] WELL SAFETY AND KILL VALVE

[75] Inventor: Thomas M. Deaton, Dallas, Tex.

[73] Assignee: Otis Engineering Corporation, Dallas, Tex.

[21] Appl. No.: 783,671

[22] Filed: Oct. 3, 1985

Related U.S. Application Data

[60] Division of Ser. No. 613,439, May 24, 1984, Pat. No. 4,566,478, which is a continuation-in-part of Ser. No. 372,134, Apr. 27, 1982, abandoned.

[51] Int. Cl.[4] ..... E21B 34/10

[52] U.S. Cl. ..... 166/323; 166/332; 166/386

[58] Field of Search ..... 166/323, 332, 386, 387, 166/373, 374; 137/112, 628, 629, 627.5; 251/73, 315

[56] References Cited

U.S. PATENT DOCUMENTS

| | | | |
|---|---|---|---|
| 3,882,935 | 5/1975 | Calhoun | 166/323 X |
| 3,970,147 | 7/1976 | Jessup et al. | 166/323 X |
| 4,103,744 | 8/1978 | Akkerman | 166/332 X |
| 4,566,478 | 1/1986 | Deaton | 166/332 X |

*Primary Examiner*—Stephen J. Novosad
*Assistant Examiner*—Thuy M. Bui
*Attorney, Agent, or Firm*—Roland O. Cox

[57] ABSTRACT

Disclosed is a safety and kill valve device useful in tubing above a packer set above a producing formation in a well, operable to shut off tubing flow and open wall flow passages to the well annulus through which heavy formation killing fluid may be pumped into the tubing. A lower ball valve is used to shut off tubing flow and an upper sleeve valve, cooperable with the ball valve, controls flow through the wall flow passage. An operating tube moves downwardly, opening the ball valve and closing the sleeve valve while compressing a spring. The compressed spring furnishes operating force to move the operating tube upwardly, closing the ball valve and opening the sleeve valve. Two embodiments operate automatically in response to higher well annulus pressures. Another embodiment may be controlled through conduit from the surface or operate automatically in response to higher annulus pressures. All embodiments may operate repeatedly without retrieving from a well.

9 Claims, 20 Drawing Figures

WELL SAFETY AND KILL VALVE

This application is a division of my co-pending application for patent, Ser. No. 06/613,439, filed May, 24, 1984, now Pat. No. 4,566,478 which is a continuation-in-part of my application for patent, Ser. No. 06/372,134, filed Apr. 27, 1982, now abaondoned.

BACKGROUND

This invention pertains to valves and in particular to dual valve devices utilizing a sleeve valve and a cooperating ball valve, a valve positioner and an operator for the valves.

PRIOR ART

When operating earth wells, it is highly desirable to have apparatus in the well which may operate to maintain pressure control and prevent "blowouts" by closing off well outflow near the producing formation and providing means to introduce heavy fluid into the well to "kill" the well.

One such system, herein incorporated by reference, is shown on p. 813 of the 34th revision of the "Composite Catalog of Oilfield Equipment and Services" and described as a "block-kill" system. This system requires numerous downhole devices such as a block-kill actuator, an actuator mandrel, control line, and a block-kill valve, which are operated by pressure in the well annulus.

The valve devices of the present invention replace all the numerous devices required in the above described system and operate to close formation outflow and open wall flow passages to allow killing fluid to flow into the tubing from the well annulus.

A valve device of this invention is installed in well tubing, above a packer and lowered into the well casing, where the packer is set above a producing formation, creating an annulus in the well and sealing between the formation and annulus. The formation is then in pressure communication with the tubing and flow passage through the valve device, and the well annulus is in pressure communication with flow ports in the valve device wall.

Two embodiments of the invention devices utilize a ball valve controlling flow through the device, connected to a sleeve valve, controlling flow through wall flow ports between the annulus outside the valve and the flow passage through the valve, and include a lock, locking the sleeve valve closed and the connected ball valve open. The lock is releasable in response to predetermined pressures. As the ball valve is opened and the sleeve valve is closed mechanically, an operating spring is compressed to furnish operating force.

The lock release in one of these embodiments is a spring loaded differential piston which is moved by greater pressure outside the valve device to compress a spring and release a collet type lock.

The lock release in the other embodiment utilizes a number of precharged bellows which respond to higher pressure outside the valve and operate to release a ratchet type lock.

One of these valves is then installed at the desired depth in the well and when annulus pressure outside the valve exceeds formation pressure inside the valve by a preset amount, the lock is released and the compressed spring closes the ball valve, closing off flow through, and opens the sleeve valve and wall flow passages to flow pumped in from the well annulus to kill the well.

A third embodiment of the valve device of this invention contains cooperating ball and sleeve valves, a lock locking the ball valve closed, a piston responsive to pressure, which is movable to compress an operating spring, release the lock, open the ball valve and close the sleeve valve. Pressured fluid is conveyed from the surface through a conduit to a sealed chamber above the piston. This device is operated in a well by increasing or reducing pressure in the conduit at the surface. This embodiment includes structure similar to that shown in U.S. Pat. No. 3,384,337 to N. F. Brown, herein incorporated for reference. When the ball valve of this embodiment of the present invention is locked closed, higher pressure in the valve body above or below the valve ball biases the seat away from the higher pressure into sealing engagement with the valve ball. Structure in the Brown patent biases the seat nearer the high pressure into sealing engagement with the valve ball.

The chamber in the third embodiment valve device could be pressured sufficiently on the surface and sealed to move the piston to compress the operating spring, release the lock, open the ball valve and close the sleeve valve. If this valve is installed in well tubing above a packer set in well casing, the piston would respond automatically to a predetermined higher pressure in the well annulus and release the compressed operating spring, to close the ball valve and tubing flow and open the sleeve valve to killing fluid flow, from the well annulus.

A ball valve device of the type shown in U.S. Pat. No. 4,140,153 to Deaton, herein incorporated by reference, is utilized in embodiments of the present invention. The ball valve could be of the type disclosed in U.S. Pat. No. 4,289,165 to Fredd.

All embodiments of the invention valve device may be reset to operate repeatedly while in place in a well.

An object of this invention is to provide an improved safety and kill valve which automatically operates when well annulus pressure is increased a predetermined amount.

An object of this invention is to provide an improved safety and kill valve wherein operating pressures may be preset.

An object of this invention is also to provide an improved block and kill valve which may be reset to operate repeatedly without retrieving from the well.

Also an object of this invention is to provide a safety and kill valve operable by conduit from the surface.

BRIEF DRAWING DESCRIPTION

FIGS. 1A and 1B together show an elevational view of an embodiment of the invention valve device, half sectioned, showing the valves positioned to operate after installation in a well.

FIGS. 2A and 2B together show a view of the valve device of FIGS. 1A and 1B after operation.

FIGS. 3A and 3B together show another embodiment of the dual valve device of the present invention in elevation, half sectioned, wherein the the valves are positioned to operate.

FIGS. 4A and 4B together show the valve device of FIGS. 3A and 3B after operation.

FIGS. 7A, 7B, 7C, 7D and 7E together show a half section elevation view of a third embodiment of the dual valve device of this invention, wherein the valves are in operating postion.

FIGS. 8A, 8B, 8C, 8D and 8E together show the valve device of FIGS. 7A, 7B, 7C, 7D and 7E after operation.

DESCRIPTION OF THE PREFERRED EMBODIMENTS

Figure 1A:
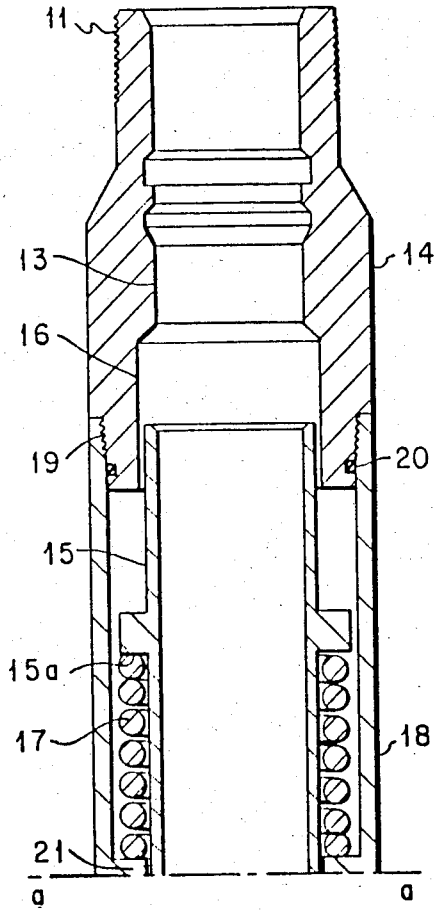
Figure 1B:
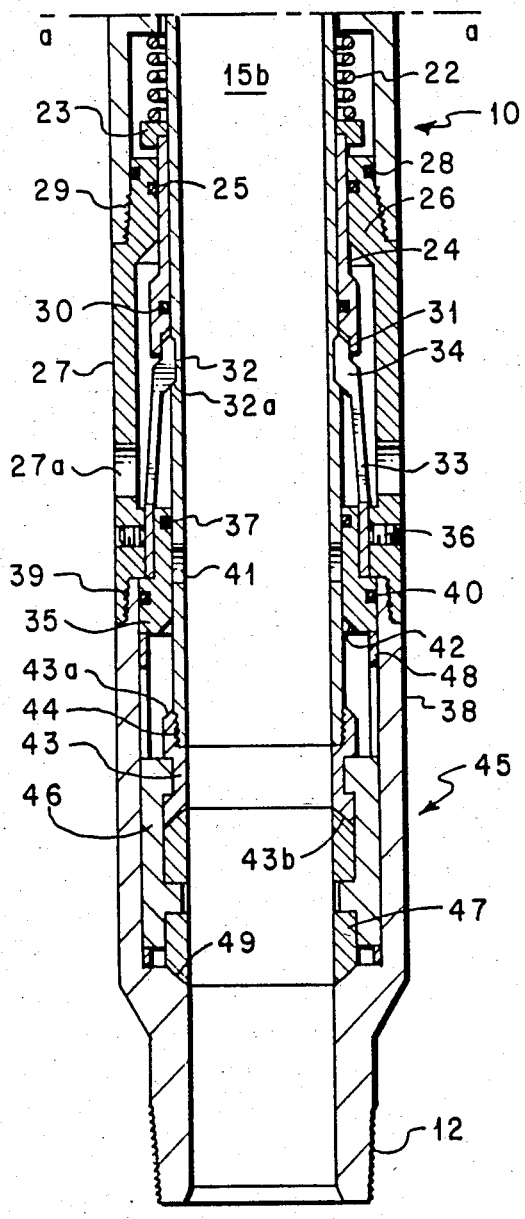

FIG. 1 shows an invention valve device 10, locked in position for installation in a well, whereon is provided an appropriate top connection 11 and bottom connection 12 for connecting the valve 10 into a well pipe string to be lowered into a well. An internal profile 13 is provided in upper connector 14. The upper end of operator tube 15 is slidably received in upper connector bore 16. A downward facing shoulder 15*a* is provided on operator tube 15 to compress operating spring 17, and a longitudinal bore and flow passage 15*b* is provided therethrough. Upper connector 14 is connected to upper housing 18 at thread 19 and sealed with seal 20. Housing 18 is provided with internal shoulder 21 on opposite sides of which press operator spring 17 and piston spring 22. The lower end of piston spring 22 presses through ring 23 on the upper end of piston 24. A seal 25 is provided in internal shoulder 26 in lower housing 27 slidably sealing piston 24 to housing 27. At least one port 27*a* is provided in housing 27. A seal 28 is also provided for sealing upper housing 18 to lower housing 27 above their connecting threads 29. Another seal 30 in piston 24 slidably seals it to the outside of operator tube 15. An internal bore 31 is provided in the lower end of piston 24, and groove 32 is formed in the outside of operator tube 15. Collet 33 with arm lug portions 34 is installed over the upper end of insert 35 and retained thereon by set screws 36. Seal 37 slidably seals insert 35 to operating tube 15. Lower connector 38 is connected to lower housing 27 at threads 39 and sealed to insert 35 with seal 40. At least one port 41 is provided in operating tube 15. A chamfered shoulder 42 is formed on the lower end of insert 35, engageable by secondary valve surface 43*a* formed on seat member 43. Seat member 43 is connected to operator tube 15 with threads 44.

The construction and operation of ball valve device 45, housed in lower connection 38, is described in U.S. Pat. No. 4,140,153. The ball valve device 45 includes shoulder 42, seat member 43, control arms 46 fitted to ball member 47 in frame 48, seat 43*b* formed on the lower end of seat member 43, and shoulder 49 in lower connector 38.

Figure 3A:
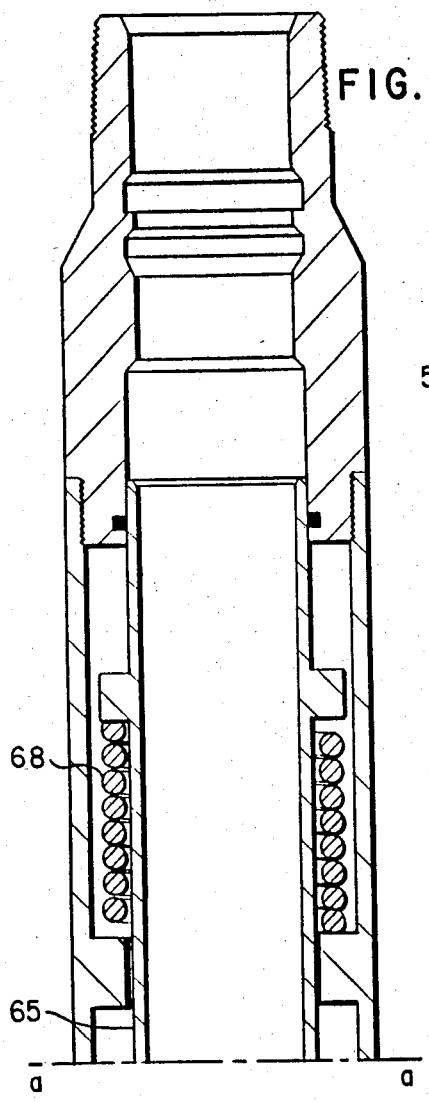
Figure 5:
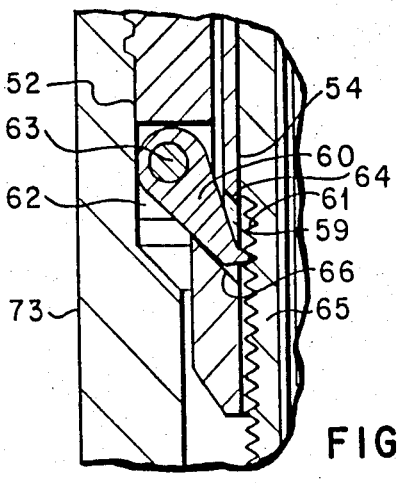
FIG. 5 is a fragmentary enlarged view of the lock mechanism of the embodiment of FIG. 3 in the locked position.
Figure 3B:
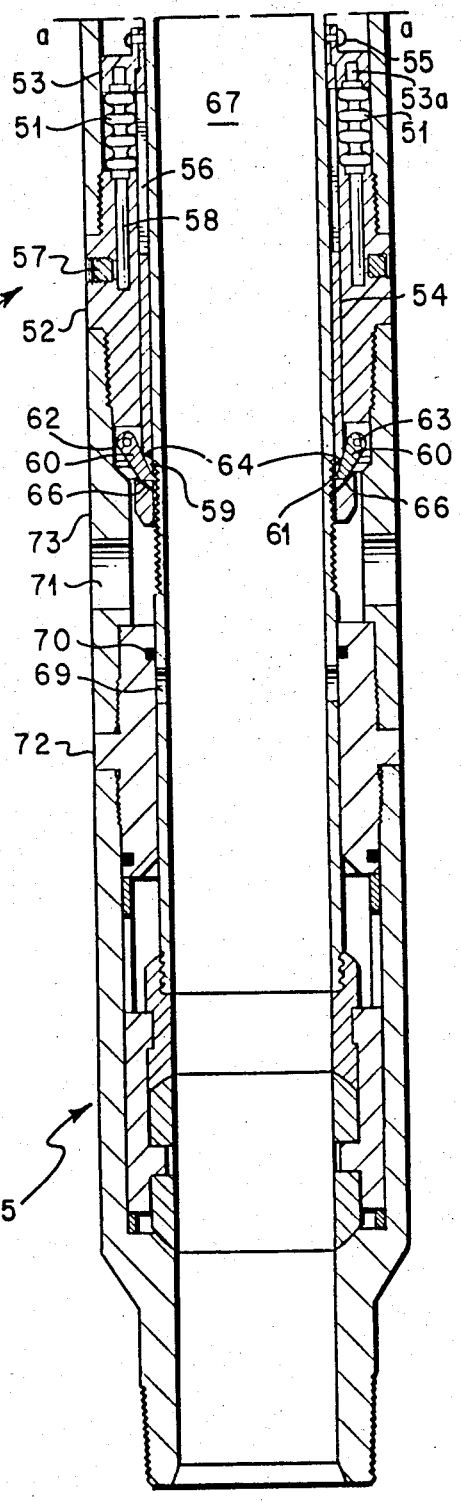
Figure 6:
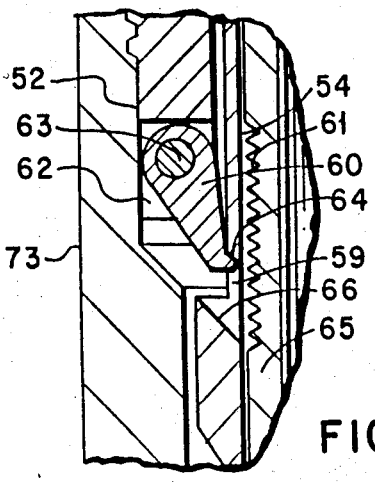
FIG. 6 is a fragmentary enlarged view of the lock mechanism of the embodiment of FIG. 3 in the unlocked position.
Figure 7A:
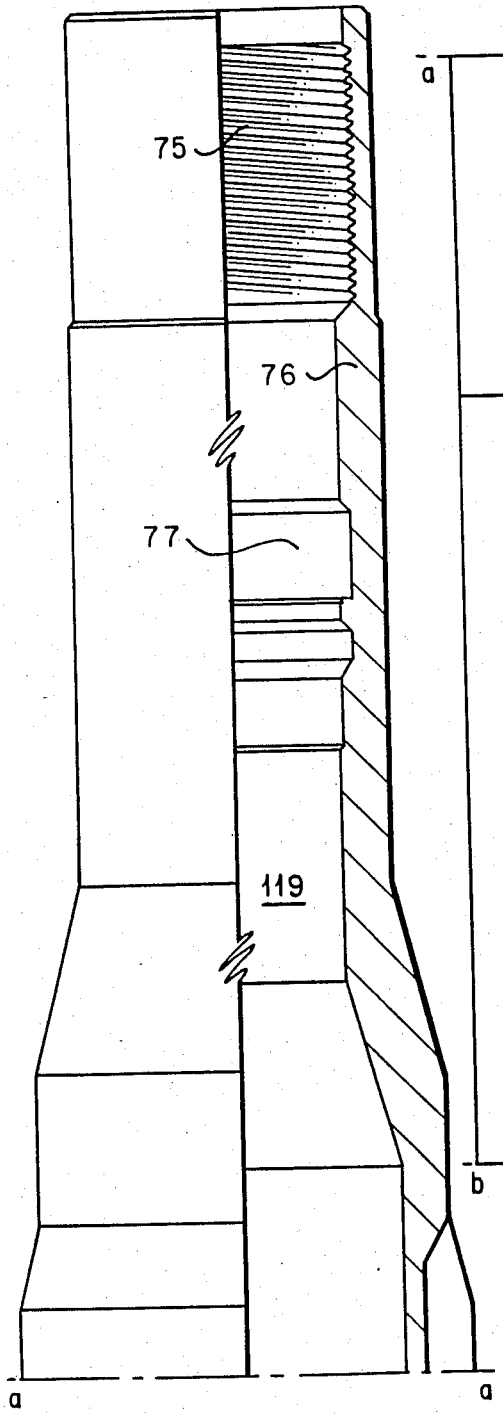
Figure 7B:
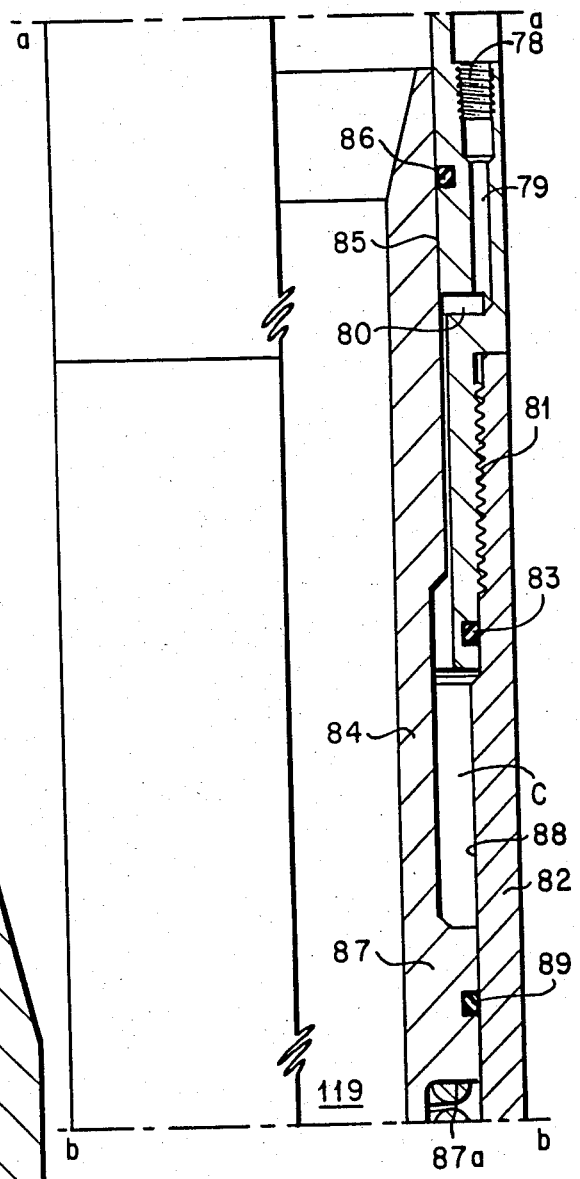
Figure 7C:
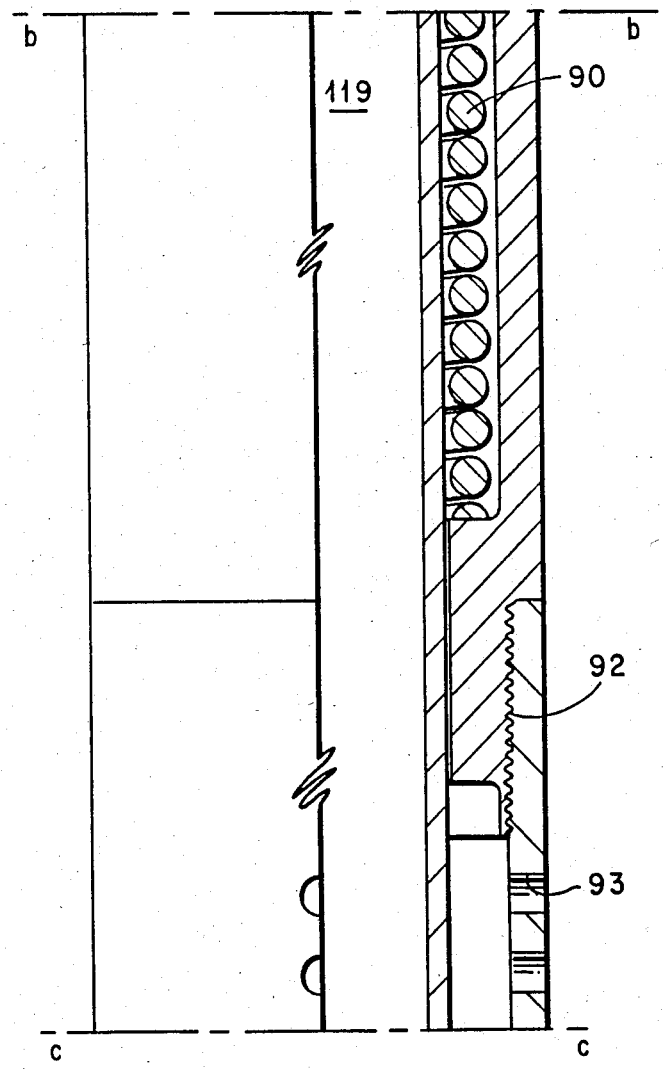
Figure 7D:
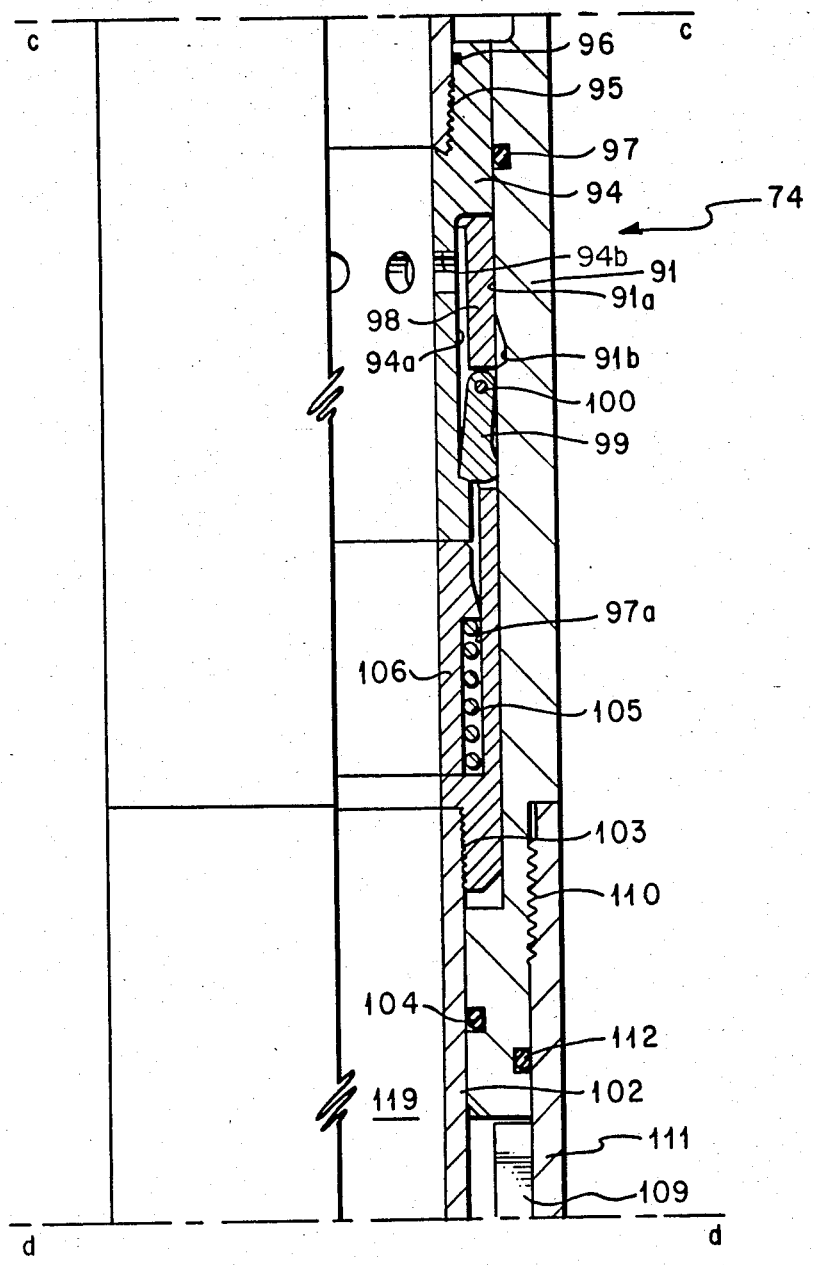
Figure 7E:
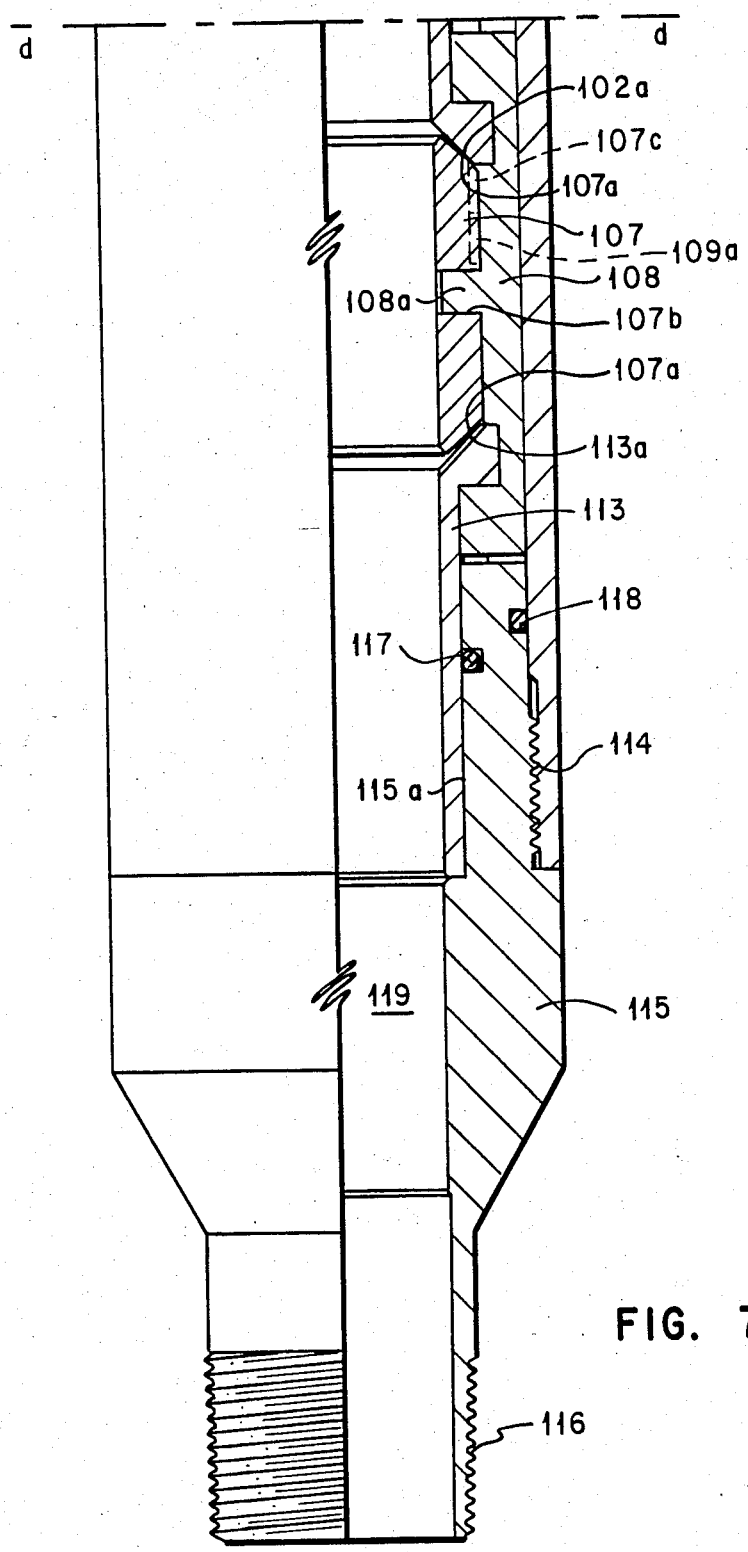
Figure 8A:
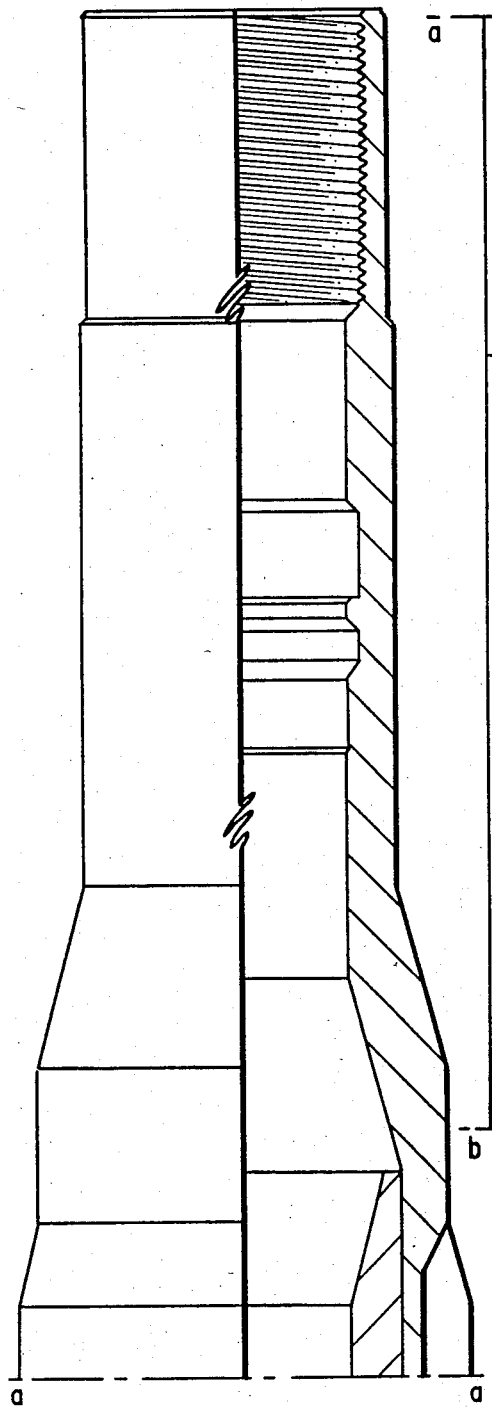
Figure 8B:
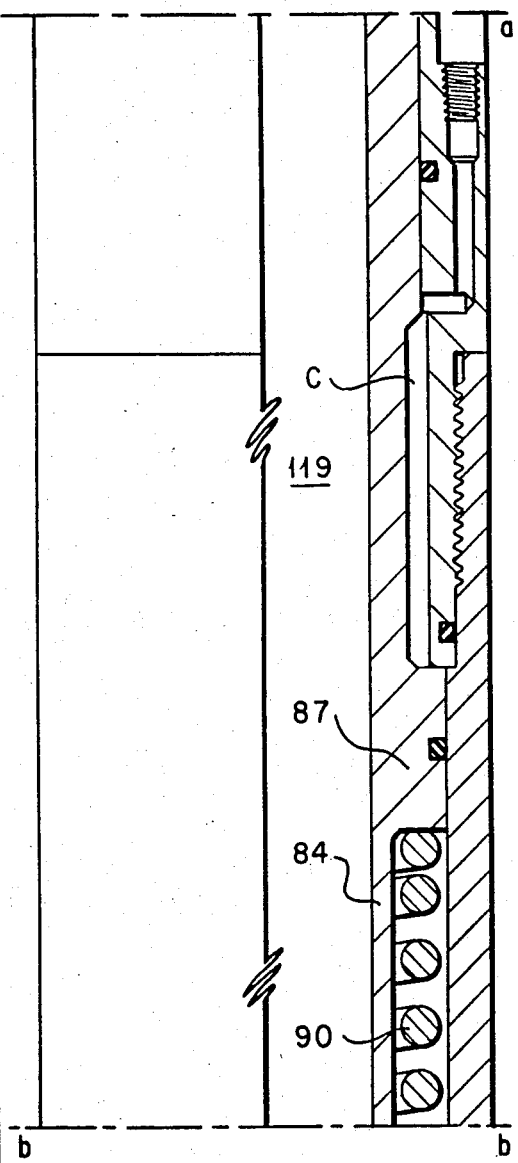
Figure 8C:
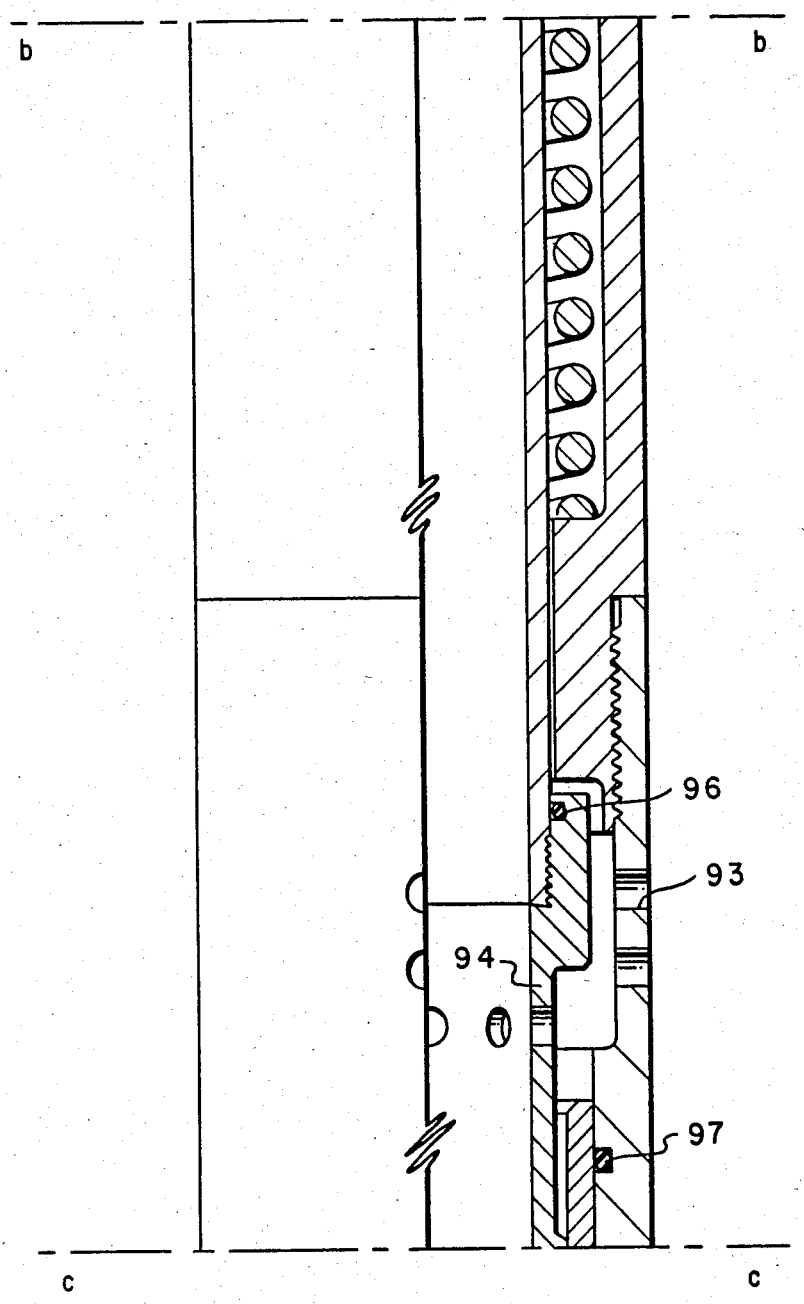
Figure 8D:
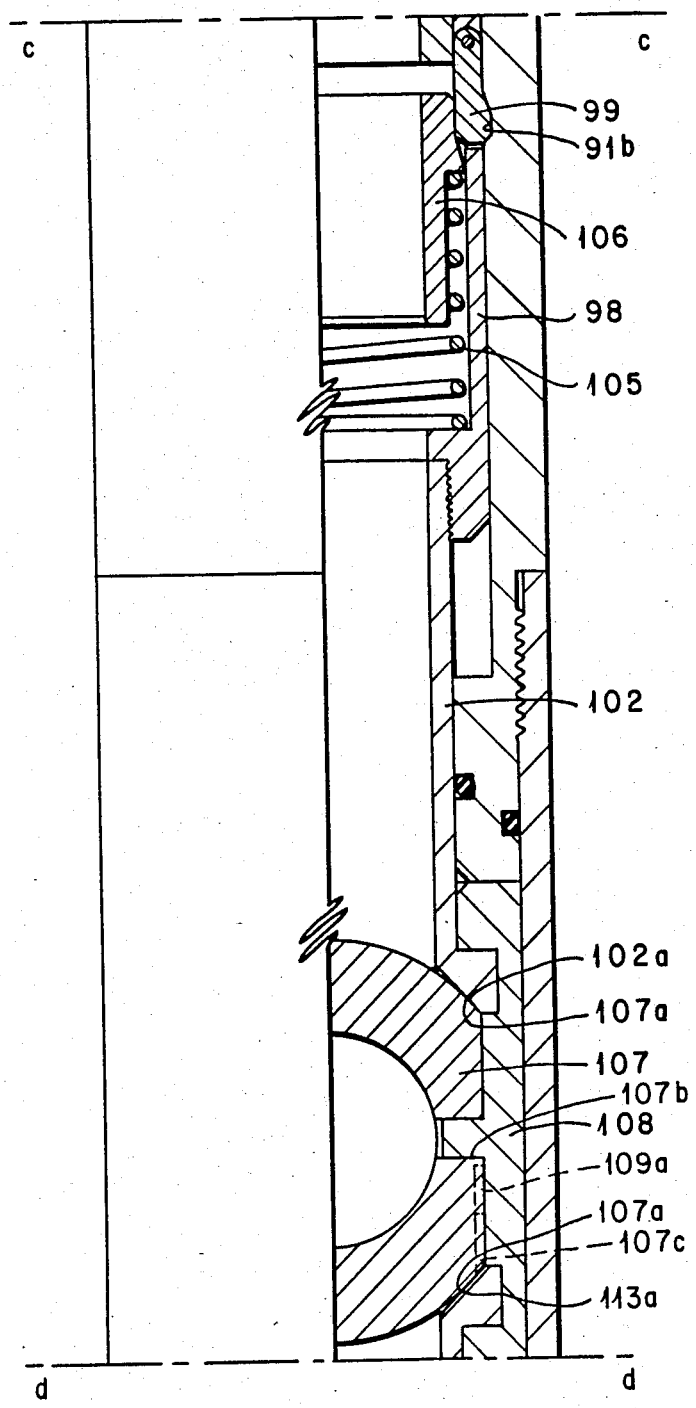
Figure 8E:
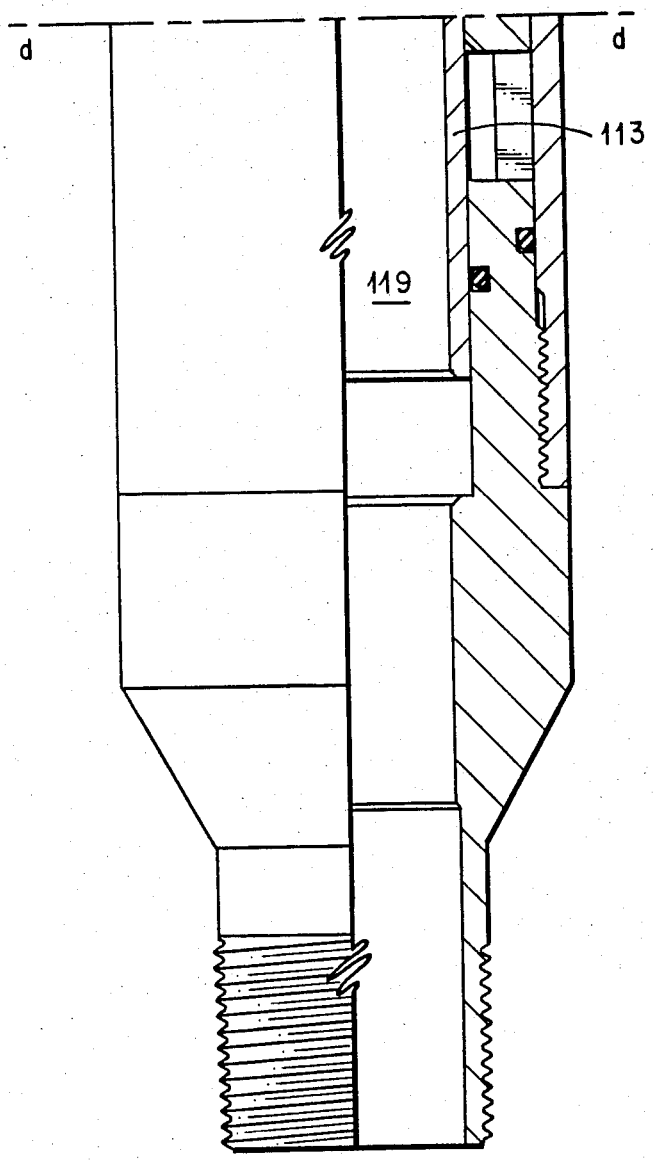

FIG. 3 shows another embodiment of the invention valve device 50 utilizing a pair of bellows 51 with lower ends joined to body connector 52. The upper ends of bellows 51 are joined to ring 53. Ring 53 is secured to latch tube 54 with screws 55 when bellows 51 are in slots 56 provided for the bellows in latch tube 54. Bellows 51 and ring 53 may be gas pressure charged internally by loosening screw seals 57, opening passages 58 to admit pressured gas into bellows 51 and ring passage 53*a*, and tightening seals 57 to seal the charge in the bellows and passages. Slots 59 are cut near the lower end of latch tube 54 through which pawls 60 may engage teeth 61 on operating tube 65 (see also FIGS. 5 and 6). Pawls 60 are positioned in opposed slots 62 in the lower end of body connector 52 and are retained by and pivot around pins 63. Camming surfaces 64 and 66 are formed at either end of slots 59 to cam pawls 60 into and out of engagement with teeth 61. The lower end of latch tube 54 is enlarged to extend camming surface 66. A longitudinal flow passage 67 is provided through operating tube 65. An operating spring 68 biases operator tube 65 upwardly. At least one port 69 is provided in tube 65. A seal 70 slidably seals tube 65 in connector 72. At least one port 71 is provided in lower housing 73.

FIG. 7 depicts a third embodiment 74 of the block and kill valve device of this invention, preferred by the inventor, shown in ball valve open position and having an appropriate thread 75 in top connection 76. The top connection has an internal profile 77, a thread 78 for connection of a control conduit from suface or a plug and connecting flow passages 79 and 80. The lower end of the top connection is provided with a thread 81 connecting the top connection to upper housing 82. Resilient seal 83 seals the top connection to the upper housing. The upper end of upper operator tube 84 is slidably received in bore 85 in the top connection and sealed to it with resilient seal 86. Formed on the upper operator tube is a piston 87 slidably received in bore 88 in the upper housing and sealed to it with resilient seals 89. A variable volume chamber C, in communication with flow passage 80, is formed by seal 83, bore 88, seal 89, piston 87 and seal 86. A compressed spring 90 is positioned in the upper housing bore around the upper operator tube between lower piston surface 87*a* and internal shoulder 82*a* in the upper body.

An intermediate housing 91 is connected to the lower end of the upper housing with thread 92 and has at least one flow port 93. Upper operating tube 84 extends through a bore in the lower end of the upper housing and is connected to lower operator tube 94 with threads 95 and is sealed to the lower tube with resilient seal 96.

The larger outside of the lower operator tube is slidable into bore 91*a* in the intermediate housing and is sealed to the intermediate housing when inside by resilient seal 97. Also slidably mounted in bore 91*a* is dog carrier 98 to which are pivotally connected a number of dogs 99 by pins 100. Interrupting bore 91*a* is a recess 91*b*. The lower tube has a groove 94*a* and is provided with at least one port 94*b*. Carrier 98 is connected to an upper seat 102 with thread 103. The upper seat is slidably sealed in the upper housing by resilient seal 104. Bore 97*a* houses a spring 105 which receives an expander 106. An annular seat 102*a* is formed at the lower end of the upper seat and the annular upper seat is held in slidable contact with the outside sealing surface 107*a* on valve ball 107 by an opposed pair of control connections 108, each having a pin portion 108*a* protruding into holes 107*b* centered in flats on opposite sides of the valve ball. Control connections 108 are slidably housed in frames 109.

Connected to the intermediate housing with thread 110 is a lower housing 111. These housings are sealed together by resilient seal 112. Lower seat 113 has a annular seat 113*a*, formed in its upper end, which is also held in slidable contact with the outer sealing surface on the valve ball by the control connections. Connected to the lower housing with thread 114 is a lower connector 115, having an appropriate lower thread 116 for connecting into well tubing. Each frame is positioned in lower housing 111 between the lower end of intermediate housing 91 and the upper end of lower connector 115. Each frame has a pin 109a which protrudes into a slot 107c in each ball flat, eccentric to the holes for connector pins 108a. Longitudinal movement of the upper seat slides the valve ball, control connectors and lower seat in the frames, and the valve ball is rotated about pins 108a by stationary frame pins 109a, between open and closed positions. Resilient seal 117 slidably seals the lower seat in lower connector bore 115a and seal 118 seals the lower connector to the lower housing. The upper and lower seat diameters sealed by seals 104 and 117 are equal and smaller than the equal seal diameters of ball 107 on annular seats 102a or 113a. Longitudinal flow passage 119 extends through valve device 74.

One embodiment of the present invention may be preferred by a well operator depending on conditions in a particular well.

Figure 2A:
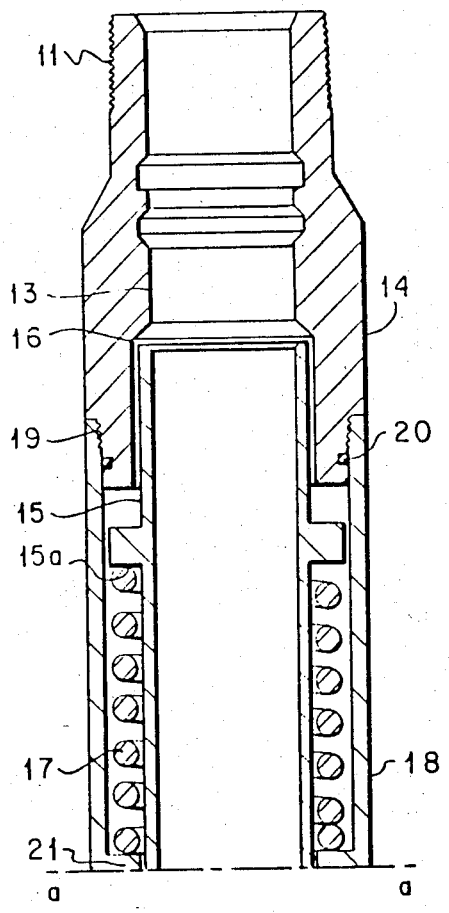
Figure 2B:
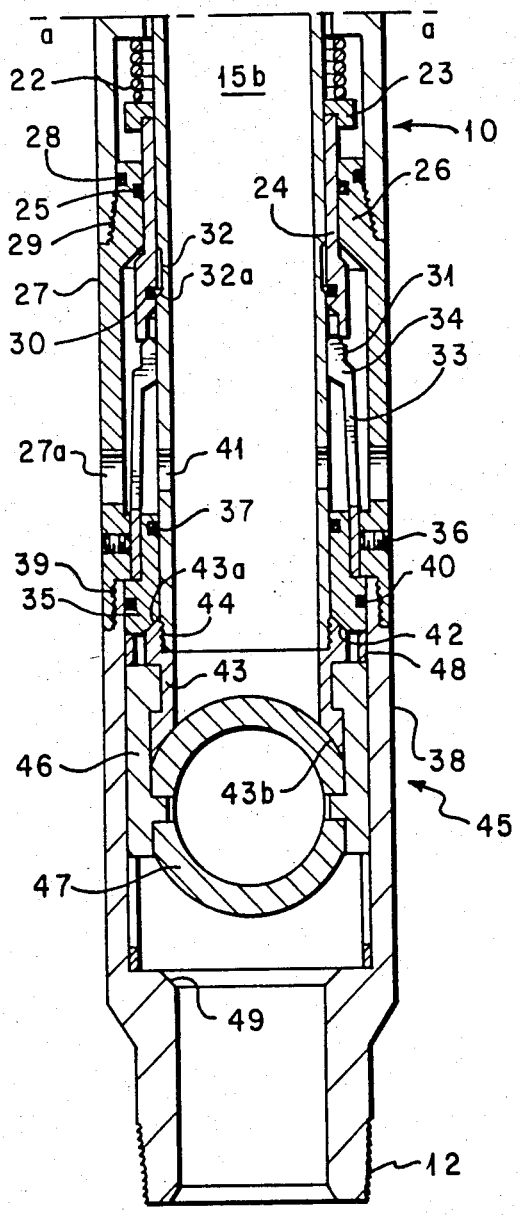

To utilize the embodiment of this invention shown in FIGS. 1 and 2, the valve 10, if not in running and operating position shown in FIG. 1, is placed in position on the surface by pushing down on the upper end of operating tube 15, to move operating tube 15 downwardly (disengaging valve 43a from shoulder 42), compressing spring 17, rotating ball valve 45 to open flow passage 15b to flow while moving ports 41 below seal 37 to close flow through ports 41. When groove 32 on tube 15 is opposite lugs 34, spring force in the collet arms 33 moves lugs 34 into groove 32 and compressed spring 22 moves ring 23 and piston 24 down and bore 31 over lugs 34 to lock lugs 34 in groove 32 and operator tube 15 and the valve 10 in running and operating position.

The valve 10 is then connected into a well tubing string above a packer and lowered to desired depth in the well where the packer is set in the well casing, sealing between the well annulus and formation. As ball valve 45 is open, two-way formation flow may occur freely through tubing and flow passage 15b, and no flow may occur through ports 41 as they are below seal 37. In the event pressure in the well annulus outside the valve 10 acting through ports 27a on the sealed differential piston area between the inside of seal 30 and the outside of seal 25 produces an upward force on piston 24 sufficient to overcome the combined downward forces of compressed spring 22 and force produced by pressure in flow passage 15b acting down on sealed differential piston area from the outside of seal 25 to the inside of seal 30, piston 24 moves up compressing spring 22. The rate of spring 22 may be preselected to determine a desired pressure difference between well tube pressure in valve flow passage 15b and greater well annulus pressure outside of valve 10 to move piston 24 up. Upward movement of piston 24 continues until bore 31 is above the upper end of lugs 34 unlocking lugs 34 to be moved out of groove 32. Compressed spring 17 maintains an upward bias on operating tube 15 sufficient to cam lugs 34 outward from groove 32 with cam surface 32a, releasing the tube 15 to be moved up until ports 41 are above seal 37 and in pressure communication with ports 27a, and ball valve 45 has rotated to close flow passage 15b and well outflow (FIG. 2). If required, fluid may be pumped down the well annulus through ports 27a and 41 into flow passage 15b and up in the well tube to a level sufficient to overcome well pressure on the lower side of the closed ball valve 45, "killing" the well.

To reposition the valve 10 to operating position, reopening ball valve 45 and closing ports 41 to flow, an appropriate tool may be lowered in the well tubing to contact the upper end of operator tube 15 and push it down to reposition valve 10 in locked operating position.

Figure 4A:
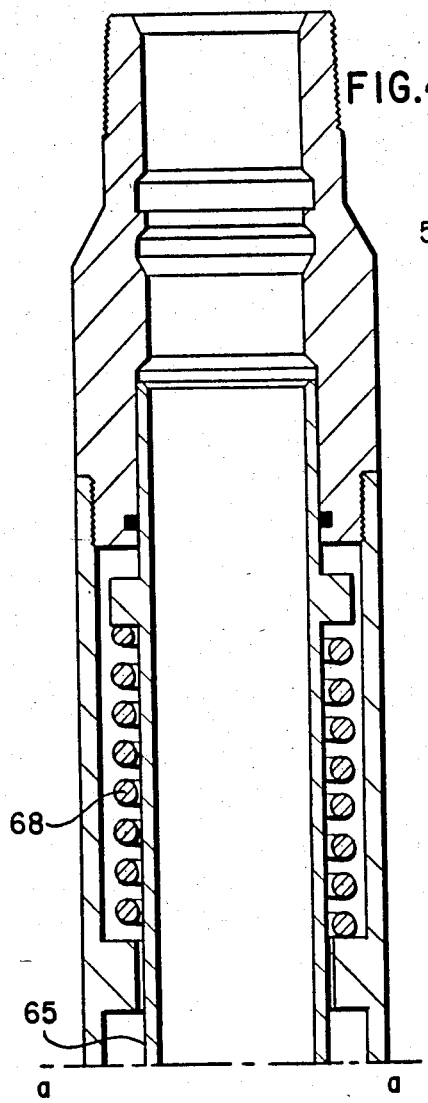
Figure 4B:
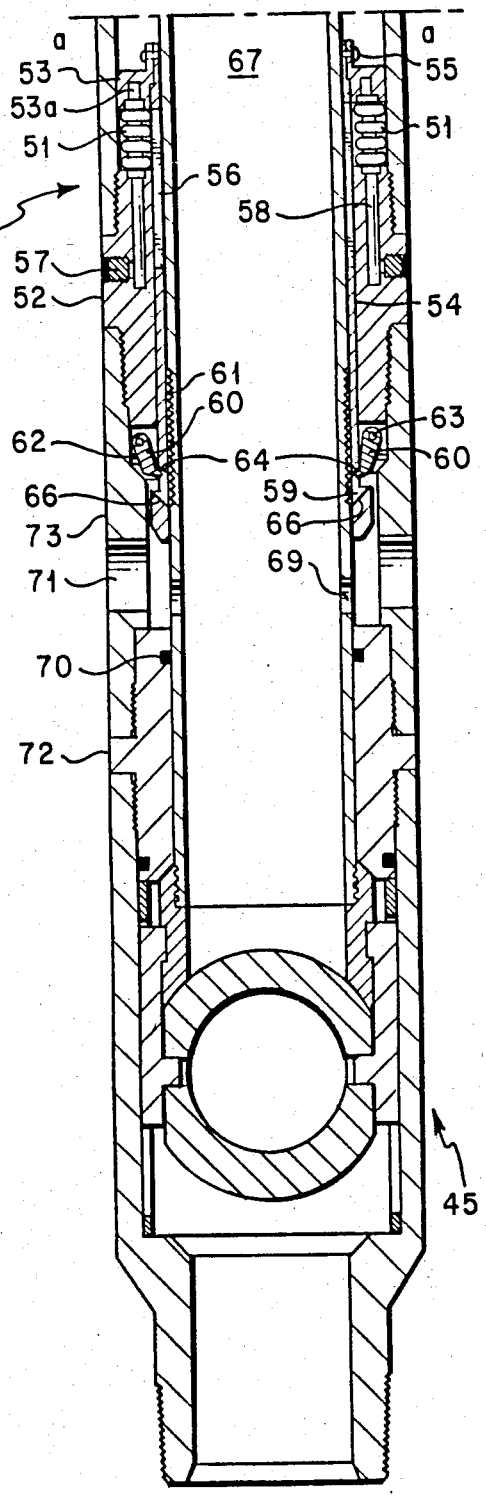

To utilize the embodiment shown in FIGS. 3 and 4, bellows 51 are pressure charged and sealed to a predetermined pressure and will automatically operate the valve device 50 in the well when pressure outside the valve is greater by a predetermined amount than pressure in bellows 51. If valve 50 is in the operated position as shown in FIG. 4, it must be repositioned to run and operate position as shown in FIG. 3 by pushing down on the upper end to move operator tube 65 down, "ratcheting" teeth 64 by pawls 60, compressing spring 68, moving ports 69 below seal 70, and rotating ball valve 45 open. The pressure charge in bellows 51 maintains the bellows extended and exerting a constant upward pull on latch tube 54. Cam surfaces 66 on tube 54 are constantly urging pawls 60 into engagement with teeth 64 on tube 65. Operator tube 65, therefore, is automatically locked in down position by pawls 60 engaging a tooth 64 (see FIG. 5). Ports 69 are now below seal 70 and closed to flow, and ball valve 45 is open for flow through flow passage 67, as shown in FIG. 3. The valve 50 is then connected in well tubing above a packer and lowered into the well to the desired depth at which the packer is set, sealing between the formation and well annulus. When well annulus pressure outside the valve 50, acting through ports 71 in housing 73 up through clearances between outside latch tube 54 and inside housing 73 and connector 52, overcomes the pressure charge in bellows 51, the well annulus pressure compresses and shortens the bellows and moves latch tube 54 down. Cam surfaces 66 are moved out of engagement with pawls 60 and cam surfaces 64 contact and cam pawls 60 around pins 63 out of engagement with teeth 61 (FIG. 6), unlocking tube 65 to be moved up by compressed spring 68. Upward movement of tube 65 moves ports 69 above seal 70 and rotates ball valve 45. Valve 45 has closed flow passage 67 to upflow and ports 69 are above seals 70 and open to flow through ports 71 into and up flow passage 67 as shown in FIG. 4.

An appropriate tool may later be lowered in the well tubing to engage the upper end of and move operating tube 65 down repositioning the dual valve 50 for repeated operation.

To install and use the block and kill valve embodiment 74 shown in FIG. 7 and 8, the variable volume chamber C of an operated valve (FIG. 8) may be pressure charged at the surface through flow passages 79 and 80 with a predetermined pressure and sealed by screwing an ordinary pipe plug into thread 78. The pressure charge acting on piston 87 operates and positions the dual valves for automatic operation in a well, when pressure exterior of the valve is sufficiently greater than pressure in valve device flow passage 119. If surface control of the operation of the valve device 74 is desired, chamber C is not pressure charged at the surface and a control conduit is connected to thread 78. The control conduit may be pressured at the surface to increase pressure in chamber C and operate the valve device.

The pressure charged or control conduit valve device 74 is then connected in well tubing above a packer and lowered into the well to the desired depth, where the packer is set to anchor and seal with well casing above a producing formation in the well and form a tubing-casing annulus above the packer.

Pressure in the well tubing-casing annulus, exterior of the pressure charged valve device 74, enters ports 93 and acts downwardly on the annular sealed area between seals 96 and 97 and also acts upwardly on the annular sealed area between seals 96 and 89. Seal 89 is larger than seal 97, so the net force is upward on operator tubes 84 and 94. Compressed spring 90 exerts an upward force on piston 87 and the operator tubes and the charged pressure in chamber C exerts a downward force on the piston. When annulus pressure exterior of the valve device is increased sufficiently to overcome downward forces on the operating tubes, the operating tubes move upwardly compressing the charge in chamber C, moving dogs 99, carrier 98, upper seat 102, control connections 108 and lower seat 113 while rotating valve ball 107 closed. The upward travel of the dog carrier, upper seat, control connectors and lower seat is stopped when the upper end of the connectors contact the lower end of intermediate housing 91 and valve ball 107 has rotated to close flow passage 119 to flow. At this time, dogs 99 are aligned with intermediate housing recess **91*b* and on continued upward movement of the operating tubes, the lower end of lower operating tube 94 disengages the upper end of expander 106 and releases spring 105 to push the expander inside the dogs expanding and locking them into engagement in recess 91*b* and valve ball 107 closed. Upward movement of the upper operator tube is stopped by the top side of piston 87 contacting the lower end of top connection 76. The lower operator tube has moved out of sealing engagement with intermediate housing seal and ports 94*b* are in pressure communication with intermediate housing ports 93 and the well annulus exterior of the valve device 74, as shown by FIG. 8. Well fluid of a gradient sufficient to overcome formation pressure may now be pumped from the well annulus through ports 93 and 94*b* into valve device flow passage 119. Closed valve ball 107 seals on annular seat 102*a* or 113*a* effectively preventing higher pressure leakage in flow passage 119 from above or below the closed valve ball 107**.

When the ball valve is locked closed, higher pressure in flow passage 119 above the valve ball acting on the sealed annular area between the larger upper seat seal diameter on valve ball 107 and smaller seal 104 biases the upper seat up. As there are very small operational clearances between movable parts, the upper seat is moved upwardly by the bias, out of sealing engagement with the ball, and minute flow may now occur through operational clearances between seat **102*a* and ball seal surface 107*a* and connectors 108 and ball 107, increasing pressure on the lower seat annular area between the larger lower seat seal on valve ball 107 and seal 117 and biasing the lower seat upwardly to sealingly engage lower seat seal surface 113*a* and ball seal surface 107*a*. The control connectors now prevent downward movement of the valve ball and lower seat, and forces tending to distort the valve ball are greatly reduced. If the higher pressure is below the locked closed valve ball in flow passage 119**, the upper seat is biased into sealing engagement with the valve ball in a like manner, and the valve ball seals on the seat away from higher pressure and valve ball distorting forces are reduced. The pressure charged valve device will be automatically repositioned to operate on sufficient reduction of pressure exterior of the valve in the well annulus.

If surface operational control is desired for valve device 74, a control line is connected to thread 78 and the valve device with control line extending to the surface is installed in the well. With no pressure in chamber C, spring 90 closes valve ball 107 and opens ports 93 and 100 to flow between flow passage 119 and the valve device's exterior. Valve 74 may be placed in operating position as shown in FIG. 7 by pressuring the control line at surface. When pressure in chamber C and down forces are sufficient, the operating tubes are moved downwardly by piston 87, opening the ball valve for flow through passage 119 and closing ports 93 and 100 to flow between passage 119 and the valve device exterior. When operation of the control line valve device is desired, pressure in the control line is reduced or annulus pressure increased sufficiently for spring 90 to move the operating tubes upwardly, opening ports 93 and 100 to flow and closing passage 119 to flow and locking valve ball 107 closed. The control line valve device may be repositioned to operate by repressuring the control conduit at the surface or reducing pressure in the annulus.

I claim:

1. A valve device for use in tubing above a packer set in casing above a well formation comprising:

(a) a housing connectable in well tubing and having a longitudinal flow passage therethrough and a flow passage through said housing wall intersecting said longitudinal flow passage;

(b) lower ball valve means controlling flow through said longitudinal flow passage;

(c) upper sleeve valve means controlling flow through said housing wall flow passages between said valve device exterior and said longitudinal flow passage, said valve means cooperable such that when said upper valve means is in closed position, said lower valve means is in open position, and when said upper valve means is in open position, said lower valve means is in closed position;

(d) locking means for holding said valve means at one position and releasing said valve means for movement to another position;

(e) pressure responsive means for releasing said locking means; and (f) operator means for operating said valve means between positions including an operator tube having a shoulder thereon, mounted for longitudinal movement in said housing, an internal shoulder in said housing and a spring disposed around said operator tube between said housing and operator tube shoulders, biasing said operator tube upwardly.

2. The valve device of claim 1 wherein the upper sleeve valve means comprise:

(a) a resilient seal in the housing below the housing wall flow passage; and (b) ports in the operator tube movable above and below said housing seal.

3. The valve device of claim 1 wherein the pressure responsive means comprise:

(a) a shoulder in the housing;

(b) a longitudinally movable piston disposed in said housing around the operator tube and slidably sealed to said housing and said operator tube; and (c) a spring disposed around said tube below said shoulder biasing said piston downwardly.

4. The valve device of claim 3 wherein the locking means comprise:

(a) a recess on the operator tube;

(b) a collet in said housing having at least one arm with a lug portion, said lug portion engageable in said recess; and (c) means retaining said lug portion engaged in said recess.

5. The valve device of claim 4 wherein the retaining means is a bore in the piston.

6. The valve device of claim 2 wherein the locking means comprise:

(a) teeth on the operator tube;

(b) a longitudinally movable latch tube around the operator tube having at least one slot therethrough, said slot having a camming surface in each end; and (c) at least one pawl, pivotally anchored in the housing and extending through said latch tube slot, said pawl having at least one tooth thereon and cammable by said slot camming surfaces to pivot and engage or disengage said operator tube teeth on movement of said latch tube.

7. The valve device of claim 6 wherein the pressure responsive means is at least one pressure charged bellows responsive to a predetermined pressure exterior of the valve device, having one end connected in said housing and the other end connected to the latch tube.

8. A valve device for use in tubing above a packer set in casing above a formation in a well comprising:

(a) a housing connectable in well tubing and having a longitudinal flow passage therethrough and a flow passage through said housing wall intersecting said longitudinal flow passage;

(b) an operator, including an operator tube having a shoulder thereon, mounted for longitudinal movement in the housing, an internal shoulder in said housing, a spring disposed around said operator tube between said housing and operator tube shoulders, biasing said operator tube upwardly;

(c) an upper sleeve valve, controlling flow through the wall flow passage between the valve device exterior and the longitudinal flow passage including: a resilient seal in the housing below the housing wall flow passage, sealingly engaging the operator tube and ports in the operator tube;

(d) a lower ball valve controlling flow through the longitudinal flow passage, having an upper seat, said ball valve cooperable with the sleeve valve such that when the upper valve is closed, said lower valve is open and when the upper valve is open, said lower valve is closed;

(e) a releasable lock in the housing, locking the upper valve closed and the lower valve open, including a recess on the operator tube, a collet in said housing having at least one arm with a lug portion, said lug portion engageable in said groove; and (f) a piston disposed in said housing around the operator tube and slidably sealed to the housing and operator tube, a bore in said piston retaining said arm lug portion engaged in said tube groove and said piston movable in response to a predetermined higher pressure exterior of the housing to release said lock arm lug from said groove and permit upward movement of said operator tube, closing said lower valve and opening said upper valve.

9. A valve device for use in tubing above a packer set in casing above a formation in a well comprising:

(a) a housing connectable in well tubing and having a longitudinal flow passage therethrough and a flow passage through said housing wall intersecting said longitudinal flow passage;

(b) an operator comprising: an operator tube having a shoulder thereon, mounted for longitudinal movement in the housing, an internal shoulder in said housing, and a spring disposed around said operator tube between said housing and operator tube shoulders, biasing said operator tube upwardly;

(c) an upper sleeve valve, controlling flow through the wall flow passage between the valve device exterior and the longitudinal flow passage including a resilient seal in the housing below the housing wall flow passage sealingly engaging the operator tube, and ports in said operator tube;

(d) a lower ball valve controlling flow through the longitudinal flow passage, having an upper seat, said ball valve cooperable with the sleeve valve such that when the upper valve is closed, said lower valve is open and when the upper valve is open, said lower valve is closed;

(e) a releasable lock in the housing, locking the upper valve closed and the lower valve open, including teeth on the operator tube, a longitudinally movable latch tube around the operator tube having at least one slot therethrough, said slot having a camming surface in each end, at least one pawl, pivotably anchored in the housing and extending through said latch tube slot, said pawl having at least one tooth thereon and cammable by said cam surface in the lower end of said latch tube slot to pivot and engage said operator tube teeth on upward movement of said latch tube and cammable by said cam surface in the upper end of said latch tube slot to pivot and disengage said operator tube teeth on downward movement of said latch tube; and (f) at least one pressure charged bellows in the housing responsive to a predetermined pressure exterior of the valve device, having one end connected to said housing and the other end connected to the latch tube, to move said latch tube downwardly and release said lock, permitting upward movement of said operator tube closing the lower ball valve and opening the upper sleeve valve.

* * * * *